US008479330B2

(12) United States Patent
Martenson

(10) Patent No.: US 8,479,330 B2
(45) Date of Patent: Jul. 9, 2013

(54) PILLOW SCARF AND METHOD OF COVERING PILLOWS ON A BED

(76) Inventor: Susan A. Martenson, Eden, UT (US)

( * ) Notice: Subject to any disclaimer, the term of this patent is extended or adjusted under 35 U.S.C. 154(b) by 0 days.

(21) Appl. No.: 13/161,360

(22) Filed: Jun. 15, 2011

(65) Prior Publication Data

US 2011/0302713 A1 Dec. 15, 2011

Related U.S. Application Data

(60) Provisional application No. 61/355,135, filed on Jun. 15, 2010, provisional application No. 61/380,543, filed on Sep. 7, 2010.

(51) Int. Cl.
*A47G 9/02* (2006.01)

(52) U.S. Cl.
USPC ..... 5/482; 5/486; 5/491

(58) Field of Classification Search
USPC ..... 5/482, 486, 490–491, 501, 503.1
See application file for complete search history.

(56) References Cited

U.S. PATENT DOCUMENTS

| | | | | |
|---|---|---|---|---|
| 4,815,156 | A * | 3/1989 | Williams | 5/485 |
| 5,118,553 | A * | 6/1992 | Boisson | 428/99 |
| 6,627,284 | B1 | 9/2003 | Naidj | |
| 2007/0022531 | A1 | 2/2007 | Lyons | |

* cited by examiner

*Primary Examiner* — Frederick Conley
(74) *Attorney, Agent, or Firm* — David W. Barman

(57) ABSTRACT

A scarf hides the upper portion of a made bed from view. The scarf includes a portion of material having a length and a width, opposite first and second ends and opposite top and bottom edges. The length of the scarf is sufficient to cover pillows placed on a made bed of standard size, with the opposite first and second ends reaching opposite first and second edges of the bed. The width of the scarf is sufficient so that its top edge hides the top edge of a pillow on the made bed, and the bottom edge hides the bottom edge of the pillow on the made bed. The scarf may be used to cover up the top edge of a bed sheet, blanket or bedspread on a made bed so as to hide said top edge of the bed sheet, blanket or bedspread.

16 Claims, 3 Drawing Sheets

PILLOW SCARF AND METHOD OF COVERING PILLOWS ON A BED

RELATED APPLICATIONS

The present invention claims priority to U.S. Provisional patent application no. 61/355,135, filed Jun. 15, 2010, and also to U.S. Provisional patent application no. 61/380,543, filed Sep. 7, 2010.

BACKGROUND

The present invention is directed to a scarf for covering pillows on a bed.

SUMMARY

In one aspect, the invention is directed to a pillow scarf. The pillow scarf comprises a portion of material having first and second sides, a top edge, a bottom edge and opposing side edges. The pillow scarf has a width W defined as a distance between the opposing side edges and a length L defined as a distance between the top and bottom edges. The width W is sufficient to cover at least one pillow placed proximate the head of a bed of standard size with the opposite first and second side edges of the pillow scarf reaching at least opposite first and second edges of the bed. The length L is sufficient to hide the at least one pillow from view between the top and bottom edges of the pillow scarf.

In some embodiments, the length of the pillow scarf may be sufficient extend part-way down opposite sides of the bed. In some embodiments, the length of the pillow scarf may be sufficient extend substantially to the floor, on both sides of the bed.

The pillow scarf may have a pattern that corresponds to a pattern of a bed sheet, blanket, or bedspread also visible on the same bed.

The pillow scarf may have indicia associated with an establishment in which the pillow scarf is placed on a bed.

In another aspect, the present invention is directed to a kit comprising the aforementioned pillow scarf and decorative material. The decorative material may comprise one or more of sequins, buttons, markers, patches and thread.

In yet another aspect, the present invention is directed to a method of covering at least one pillow positioned proximate the head of a bed of standard size. The method comprises providing a pillow scarf according the above-described pillow scarf; and covering the pillows so that the opposite first and second ends of the pillow scarf reach at least opposite first and second edges of the bed, and the pillow scarf fully hides the at least one pillow from view between the top and bottom edges of the pillow scarf.

In still another, aspect, the present invention is directed to a method of covering up the upper edge of a sheet, blanket or a bedspread on a bed of standard size. The method comprises providing a pillow scarf according the above-described pillow scarf; and covering the upper edge of a sheet, blanket or a bedspread by placing the pillow scarf such that opposite first and second ends of the pillow scarf reach at least opposite first and second edges of the bed, and the top and bottom edges of the pillow scarf straddle the top edge of the sheet, blanket or a bedspread to thereby hide the latter from view.

DETAILED DESCRIPTION

Figure 1:
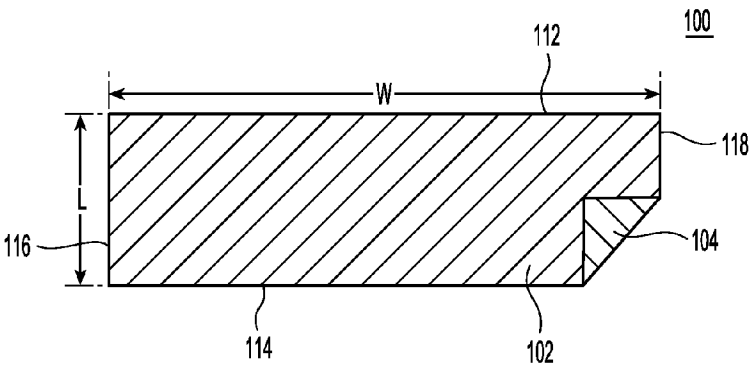
FIG. 1 shows one embodiment of a pillow scarf in accordance with the present invention.

FIG. 1 shows a pillow scarf 100 in accordance with one embodiment of the present invention. The pillow scarf 100 comprises a generally rectangular piece of bedding material having opposing first and second sides 102, 104, a top edge 112, a bottom edge 114, and two opposing side edges 116, 118.

The first and second sides 102, 104 may have dissimilar colors, patterns and may even comprise different fabrics sewn or otherwise fixed to one another back-to-back.

As seen in FIG. 1, the pillow scarf 100 has a width W defined as the distance between the side edges 116, 118, and a length L defined as the distance between the top and bottom edges 112, 114.

The pillow scarf 100 is placed over the upper portion of a bed to cover the pillows and/or an upper edge of one or more other articles of bedding such as a sheet, a blanket, a comforter, a bed spread or the like.

Figure 2:
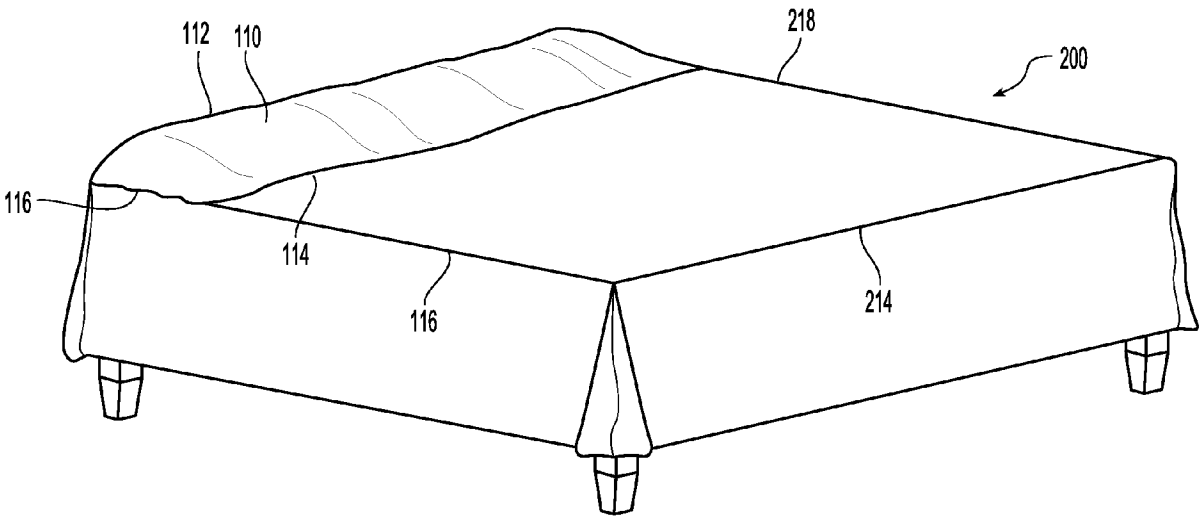
FIG. 2 shows a pillow scarf which extends to the edge of a bed.

As seen in FIG. 2, when in use, the top edge 112 of the pillow scarf 100 is closest to the top edge or headboard 210 of a bed 200 while the bottom edge 114 of the pillow scarf is away from the top edge or headboard 210 so as to cover the bedding. Thus, the length L of a pillow scarf must be sufficiently large to cover a pillow in the direction from the head of the bed to the foot 214 of the bed. In some embodiments, the length L of the pillow scarf is between 22-26 inches or about 56-66 cm.

The width W of the pillow scarf 100 must be sufficiently large to at least extend across the width of a bed 200, from a first bed side 216 to the opposite bed side 218 with sufficient "slack" to cover underlying pillows. In the embodiment seen in FIG. 2, the pillow scarf 100 is an edge-width pillow scarf 200, having a width sufficiently to only extend to the bed's opposite edges 216, 218.

Figure 3:
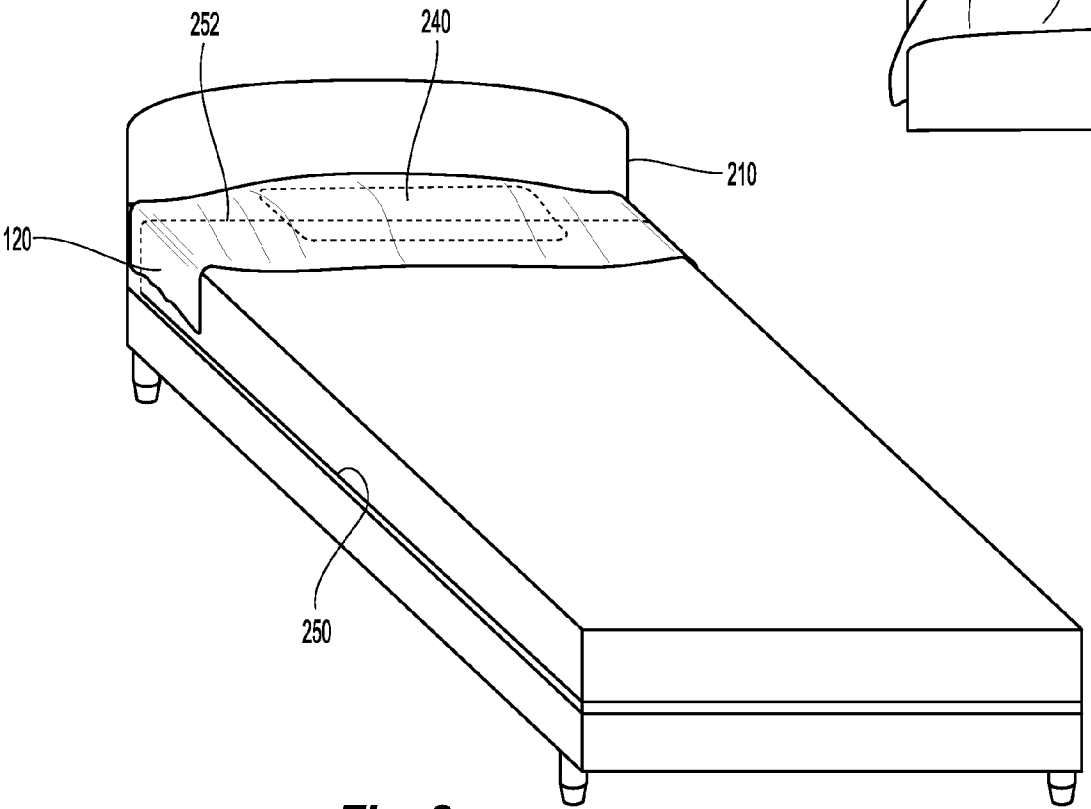
FIG. 3 shows a pillow scarf on a bed with an underlying pillow and an upper edge of another article of bedding shown in phantom.

FIG. 3 shows that a pillow scarf 120 covering not only the underlying pillow 240, but also the upper edge 252 of another bedding item 250, the upper edge 252 shown to terminate across the pillow 240. It is understood that bedding item could be a sheet, blanket, bedspread, comforter or the like. It is understood that the underlying pillow 240 may be positioned either under or over the upper edge 252. Thus, placing the pillow scarf 120 on the bed will simultaneously hide both the underlying pillow 240 and the upper edge 252 of the bedding item 250.

Figure 4:
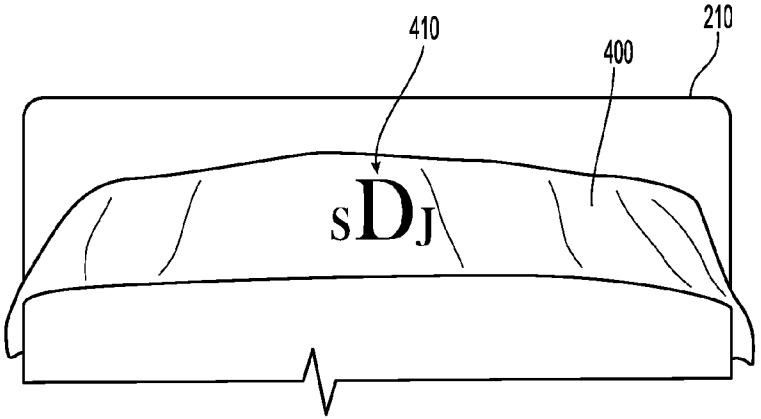
FIG. 4 shows a pillow scarf on a bed, the pillow scarf having indicia thereon

FIG. 4 shows a pillow scarf 400 having indicia 410 placed thereon. The indicia may be associated with an establishment, such as a hotel, resort or the like, in which the pillow scarf is placed on a bed. While the indicia 410 is seen in FIG. 4 to be a monogram, it is understood that the indicia could just as easily be a logo, symbol, word, phrase or the like.

Figure 5:
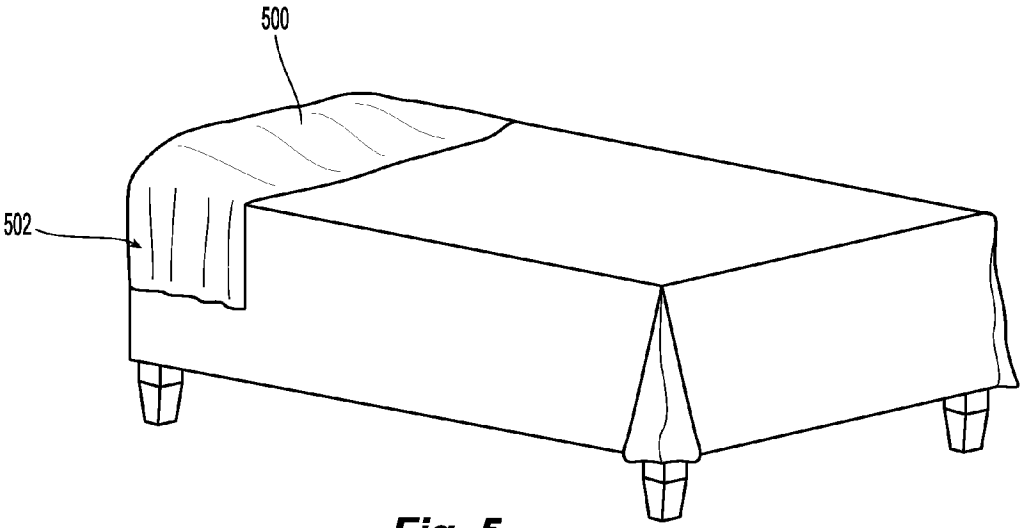
FIG. 5 shows a pillow scarf which extends mid-way along the side of a bed.

FIG. 5 shows an embodiment of a medium-width pillow scarf 500 having a width sufficient to cover the upper surface of the bed and also extend approximately mid-way down the side of the bed, roughly to the border between a mattress and box spring. The pillow scarf portion 502 extending down the side of the bed may have a different color and/or pattern than the portion covering the upper surface of the bed.

Figure 6:
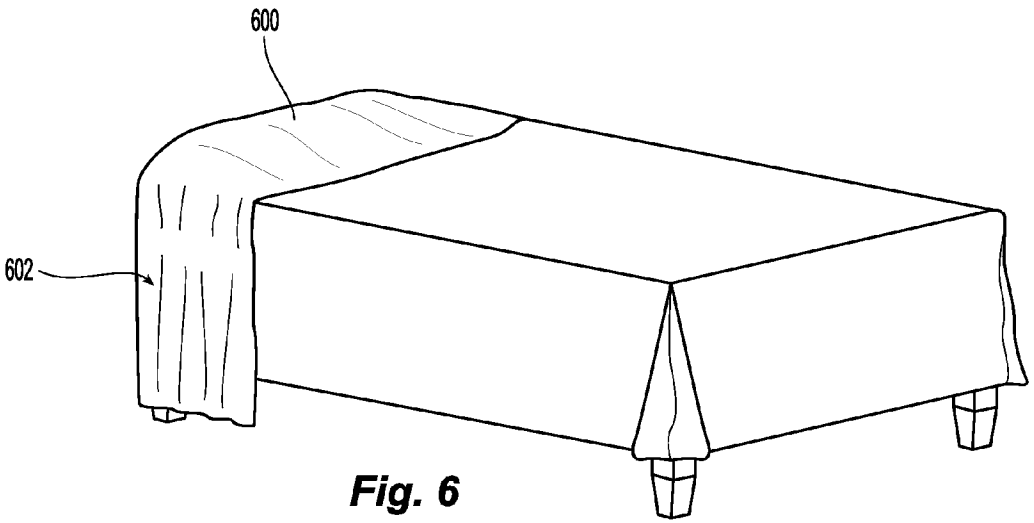
FIG. 6 shows a pillow scarf which extends to the floor along the side of the bed.

FIG. 6 shows an embodiment of a floor-width pillow scarf 600 having a width sufficient to cover the upper surface of the bed and also extend substantially to the floor along the side of the bed. The pillow scarf portion 502 extending down the side of the bed may have a different color and/or pattern than the portion covering the upper surface of the bed.

As is commonly known, standard-sized beds come in a variety of sizes including twin, twin XL, full, full XL, queen and king. Thus, it is contemplated that a manufacture and/or retailer will provide a family of pillow scarves having similar patterns and different widths. Table 1 below presents approximate pillow scarf widths for varying bed sizes and varying bed side coverage.

TABLE 1

Pillow Scarf Width Ranges For Varying Bed Sizes and Varying Bed Side Coverage

| | Edge-Width | Medium-Width | Floor-Width |
|---|---|---|---|
| Twin | 43"-47" | 72"-76" | 79"-83" |
| Twin XL | 43"-47" | 72"-76" | 79"-83" |
| Full | 58"-62" | 87"-91" | 94"-98" |
| Full XL | 58"-62" | 87"-91" | 94"-98" |
| Queen | 64"-68" | 92"-96" | 100"-104" |
| King | 82"-86" | 108"-112" | 118"-122" |

A pillow scarf kit marketed to the general consumer may include an appropriately sized and shaped pillow scarf as described above, along with additional decorative material, such as sequins, buttons, markers, patches and even thread. The consumer may purchase such a kit and decorate the pillow scarf, as desired.

It can be seen from the foregoing, that a pillow scarf may provide a number of benefits. First, a pillow scarf in accordance with the present invention is able to cover sleeping pillows and the upper edges of a sheet, blanket or comforter, so that the bed appears to be fully made, even if it is not. In addition, a pillow scarf may be used to cover mismatched items of bedding, such as pillows having different pillow cases. Thus, placing a pillow scarf over the upper portion of a bed can be an easy and forgiving way to help make a bed. In addition, the pillow scarf allows for a single piece of bedding to change the appearance of the made bed especially when the pillow scarf has a pattern not present on the visible bedding on the remaining portion of the bed.

When used in the hotel industry, the pillow scarf can create a quick and inexpensive way to create a signature look to improve the hotel brand. Rather than having a given hotel's logo placed on a large bed spread, the hotel might opt for applying such logos to much smaller pillow scarves, thereby saving expense in the long run, especially in the event that the logo is changed.

The foregoing disclosure provides illustrative embodiments of the invention and is not intended to be limiting. It should be understood that modifications of the disclosed embodiments are possible within the spirit and scope of the invention, and the invention should be construed to encompass such modifications.

What is claimed is:

1. A pillow scarf consisting of:

a portion of material having first and second sides, a top edge, a bottom edge and opposing side edges;

a width W defined as a distance between the opposing side edges and a length L defined as a distance between the top and bottom edges;

indicia placed on the portion of material; wherein:

the width W is sufficient to cover at least one pillow placed proximate the head of a bed of standard size with the opposite first and second side edges of the pillow scarf reaching at least opposite first and second edges of the bed; and the length L is sufficient to hide the at least one pillow from view between the top and bottom edges of the pillow scarf, wherein said material is free of special folds and tucks.

2. The pillow scarf according to claim 1, wherein: the width W is sufficient to extend mid-way down, on both sides of the bed.

3. The pillow scarf according to claim 1, wherein: the width W is sufficient to extend substantially to the floor, on both sides of the bed.

4. The pillow scarf according to claim 1, wherein the width W is between 94" and 98".

5. The pillow scarf according to claim 1, wherein the width W is between 100" and 104".

6. The pillow scarf according to claim 1, wherein: opposite sides of the portion of material have a different color and/or pattern.

7. The pillow scarf according to claim 1, wherein the indicia is decorative material attached to the pillow scarf, where the decorative material selected from the group consisting of sequins, buttons, markers, patches and thread.

8. The pillow scarf according to claim 1, wherein the width W is between 82" and 86".

9. The pillow scarf according to claim 1, wherein the width W is between 108" and 112".

10. A method of covering at least one pillow located proximate the head of a bed of standard size, consisting of:

selecting a pillow scarf in accordance with claim 1; and covering at least one pillow with the pillow scarf so that:

the opposite first and second side edges of the pillow scarf reach at least opposite first and second edges of the bed, and the pillow scarf fully hides the at least one pillow from view between the top and bottom edges of the pillow scarf.

11. The method according to claim 10, wherein: covering the at least one pillow simultaneously covers an upper edge of a sheet, blanket, bedspread or comforter also placed on the bed.

12. A method of covering up an upper edge of a sheet, blanket, bedspread or comforter placed on a bed of standard size, consisting of:

selecting a pillow scarf in accordance with claim 1;

covering the upper edge of the sheet, blanket, bedspread or comforter with the pillow scarf so that:

the opposite first and second side edges of the pillow scarf reach at least opposite first and second edges of the bed, and the pillow scarf straddles the upper edge of the sheet, blanket, bedspread or comforter, thereby hiding said upper edge from view.

13. The method according to claim 12, wherein: covering the upper edge of the sheet, blanket, bedspread or comforter with the pillow scarf simultaneously covers at least one pillow on the made bed, which at least one pillow is positioned either under or over said upper edge.

14. The pillow scarf according to claim 1, wherein the indicia is selected from the group consisting of a monogram, a logo, a symbol, a word, or a phrase.

15. The pillow scarf according to claim 1, wherein the indicia is associated with a commercial establishment in which the pillow scarf is located.

16. The pillow scarf according to claim 1, wherein the width W is between 118" and 112".

* * * * *